United States Patent [19]

Linster

[11] Patent Number: 4,973,028

[45] Date of Patent: Nov. 27, 1990

[54] RESCUE TOOL JAW

[75] Inventor: Robert J. Linster, Chalfont, Pa.

[73] Assignee: Hale Fire Pump Company, Conshohocken, Pa.

[21] Appl. No.: 439,492

[22] Filed: Nov. 21, 1989

[51] Int. Cl.[5] ..... B66F 3/24

[52] U.S. Cl. ..... 254/93 R

[58] Field of Search ..... 254/18, 93 R, 93 H, 254/93 HP, 124, 104; 72/392, 705; 29/252; 81/301, 302, 349, 383.5

[56] References Cited

U.S. PATENT DOCUMENTS 3,819,153 6/1974 Hurst et al. ..... 254/93 R
4,333,330 6/1982 Porter ..... 72/705
4,782,687 11/1988 Papesh ..... 254/93 R
4,789,134 12/1988 Tenuto et al. ..... 72/705
4,842,249 6/1989 Weigard ..... 254/93 R

OTHER PUBLICATIONS

Products Catalog of Hale Fire Pump Company, entitled "Highway Heros", dated 1988.

*Primary Examiner*—Robert C. Watson
*Attorney, Agent, or Firm*—Frank A. Follmer

[57] ABSTRACT

A jaw adapted to be mounted on the end of the force arms of a rescue tool for engaging a part to be spread is provided with a plurality of teeth having a substantial depth and oriented to point toward the tip end of the jaw for biting into and grabbing the working surface of the part to be spread.

20 Claims, 2 Drawing Sheets

FIG. 2
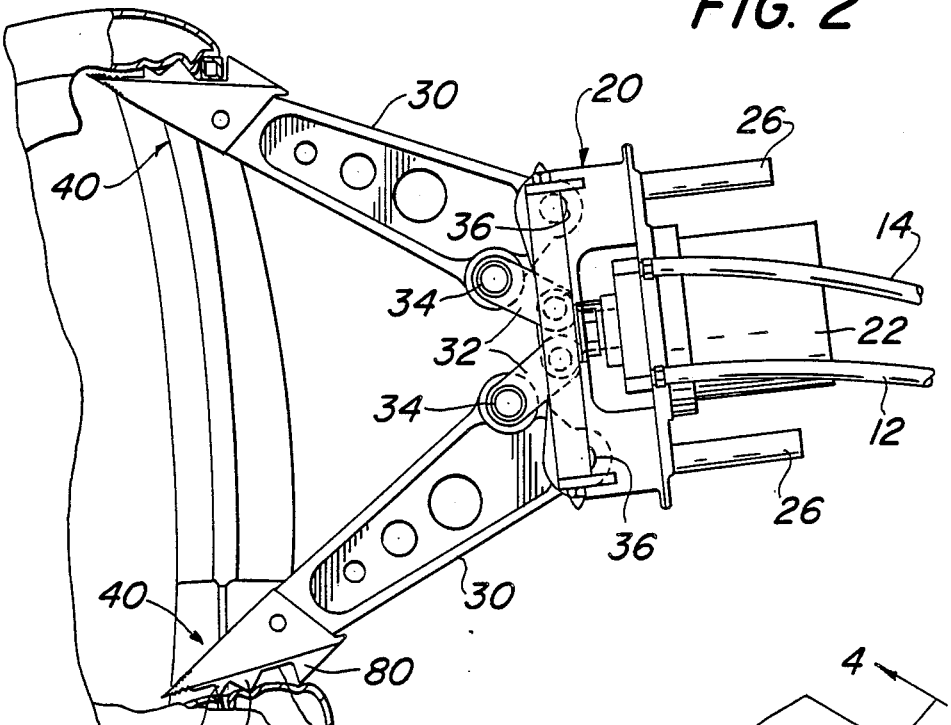
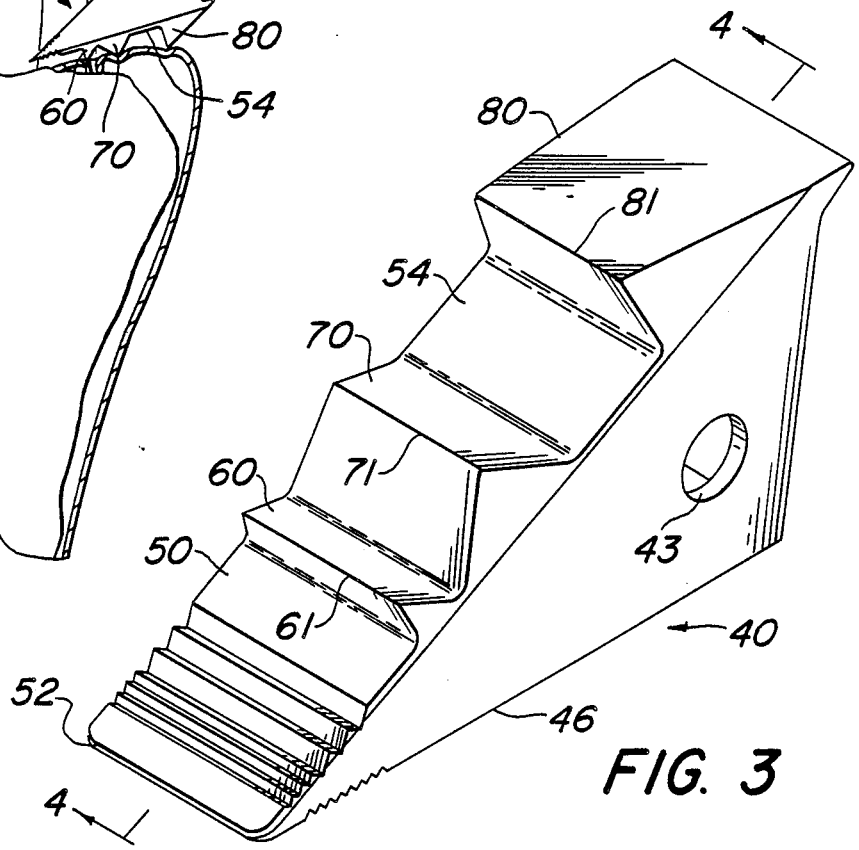
FIG. 3

RESCUE TOOL JAW

BACKGROUND OF THE INVENTION

1. Field of the Invention

This invention relates generally to portable rescue tools and, more particularly, to a jaw constructed for use with such rescue tools. Rescue tools of the indicated type are well known and are used for aiding in the rescue of accident victims trapped in the wreckage of an automobile, an airplane or the like. One well known type of rescue tools are those of the "JAWS OF LIFE" rescue system manufactured by Hale Fire Pump Company.

2. Description of the Prior Art

Typical of the rescue tools in use today are those described in U.S. Pat. No. 3,819,153 which discloses a fluid-powered rescue tool utilizing a base and a pair of force arms to supply a high magnitude push-pull force for removing occupants from wreckages and for separating wreckages of automobiles or the like which have become entangled together. One type of rescue tool disclosed in said patent is known in the art as a spreading tool. Spreading tools are used in rescue or other types of operations to pry, bend, spread, pull and lift a structure during a rescue or other type of operation. Examples of specific applications of spreading tools are (1) a condition where it is necessary to spread a damaged windowframe of a wrecked automobile to gain access to the automobile or providing a way that an injured person can be removed through the window opening, (2) a condition where it is necessary to move a seat in a damaged automobile, (3) a condition where it is necessary to raise a collapsed dashboard of a wrecked automobile, and (4) a condition where it is necessary to raise the collapsed steering column of an automobile. In the last-mentioned example it is often difficult to position the rescue tool so that the tip of one of the force arms will engage the steering column without sliding.

The spreading tools in use today comprise field replaceable tips or jaws which are mounted on the end of the force arm. The jaws are adapted to contact or engage the part to be spread at a work engaging surface of the jaw, which surface is provided with a plurality of teeth. In the jaws in use today these teeth are formed of shallow serrations extending throughout the work engaging surface in an evenly spaced arrangement. Because of the shallowness, orientation, configuration and arrangement of the teeth on the prior art jaws, in some applications difficulty has been encountered in maintaining engagement between the work engaging surfaces of the jaws and the part to be spread. This failure to maintain engagement becomes most serious when the force arms are spread apart a substantial amount at the end of the spreading cycle. The jaws of the prior art have a tendency, in some applications, to skip out and jump back at the operator and also to slip along the material being worked on by the jaws. Also, in some applications, particularly when the jaws are spread apart a substantial amount, the tool may actually jump into the car and endanger an occupant thereof. Further, the jaws of the prior art present problems in maintaining engagement with a steering column during an operation in which the steering column is lifted away from the driver. While the serrated type of construction of the prior art is designed to secure the jaws to the work area, a problem develops as the spreading of the jaws increases because the material being worked on often bends and forces itself away from the shallow serrations of the prior art jaw thereby resulting in a slipping of the jaw relative to the material being worked on by the jaw.

SUMMARY OF THE INVENTION

It is the general object of the invention to provide an improved jaw for a rescue tool of the indicated type whereby the jaw is constructed to provide the ability to bite into and grab the material being worked on and maintain this engagement throughout the entire spreading movement of the rescue tool. To this end, the jaw in accordance with the invention is provided with teeth having various geometric shapes that vary in height and are oriented and arranged in spaced apart relation such that the jaw teeth have the ability to bite into and grab the material being acted on so that the jaw holds onto or grabs the part being spread throughout the spreading movement of the force arms of the rescue tool. The jaws of the invention actually puncture the metal parts of an automobile and bite into it so as to hold the jaw stable throughout the spreading operation. To this end there is provided a gap between two adjacent teeth so that when these teeth are forced against the metal part of an automobile, such as on the roof thereof, the jaw is secured there so that during the spreading operation the tool cannot move forwardly into the automobile. This large notched area also provides the ability to grab the steering column, or any large surface, with a much more stable contact than with the prior art jaws. Further, the teeth of the jaws are configured such that as the tool is spread apart, the teeth extend at varying and different angles toward the surfaces of the work area so that there is always at least one tooth that is positioned to bite into the material being worked on.

In summary, the jaws in accordance with the invention provide far greater spreading capability, more flexibility as far as grabing various type surfaces, and more versatility in use. Further, since the teeth are larger and deeper, they remain effective longer since a small amount of wear on their edges will not make them unserviceable.

BRIEF DESCRIPTION OF THE DRAWINGS

FIG. 2 is a view illustrating the use of the spreading tool shown in FIG. 1 for applying a spreading force to a door window of an automobile.

FIG. 3 is a perspective view of a jaw in accordance with the invention.

DETAILED DESCRIPTION OF THE INVENTION

Figure 1:
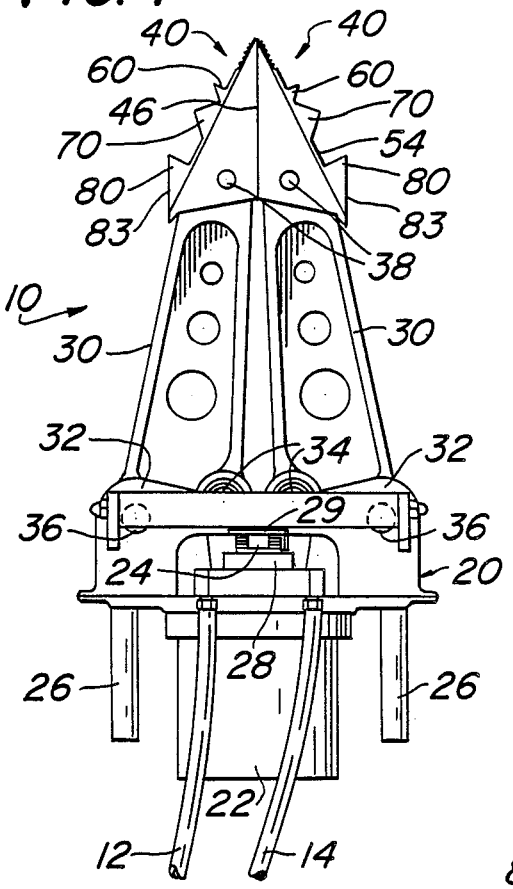
FIG. 1 is a side elevational view of a spreading tool provided with a pair of jaws in accordance with the invention.

In FIGS. 1 and 2 of the Drawings there is shown a portable, fluid-powered rescue tool 10 of the type manufactured and sold by Hale Fire Pump Company designated as the JL-32B spreading tool. Tool 10 is well suited for use at the scene of an automobile accident and other types of emergencies and has a lightweight construction so that it can be operated with relative ease by a single operator. The tool is applicable to a wide variety of accident or other emergency situations where a rapid, high magnitude spreading force application is required. In use, tool 10 is fluid powered by a lightweight, portable, self contained fluid power generating unit or pump (not shown) of a type well known in the art. Hydraulic fluid is supplied from the pump under pressure to the tool 10 through a high pressure, flexible hydraulic supply line 12 and low pressure, exhausted hydraulic fluid is returned from the tool 10 to the pump by way of a flexible, hydraulic return line 14. Tool 10 comprises a main body 20 made of a high strength lightweight material, such as an aluminum alloy forging, which includes an elongated cylindrical fluid chamber or cylinder 22 having a fluid-actuated piston (not shown) slidably disposed therewithin for controlled movement back and forth within the cylinder 22. The piston is secured to the end of a piston rod 24 for movement back and forth along the longitudinal axis of the tool 10. The body 20 is provided with a pair of convenient carrying handles 26. A control valve 28 is mounted on body 20 adjacent cylinder 22 and is adapted to control the fluid flow to either side of the piston within cylinder 22 depending on the control position of a manually operable control handle 29.

As is described in detail in said U.S. Pat. No. 3,819,153 and pursuant to the design employed in said JL-32B spreading tool, the piston rod 24 is provided at its extended end with a linkage pin assembly comprising a pair of short link members 32 that are pivotally connected to the inner corners of a pair of triangular force arms 30 by means of a pair of pivot pins 34. These inner pivot pins 34 form movable pivot axes for the force arms 30 with respect to a pair of fixed pivot axes thereof formed by outer pivot pins 36 mounted on body 20. The design is such that when the piston rod 24 is moved, or extended, outwardly from the retracted position shown in FIG. 1, the force arms 30 pivot in opposite directions about pins 36 and are caused to open or spread apart as the tip ends of the force arms 30 move away from each other. Thus, force arms 30 are movable, during a spreading movement, from the closed position shown in FIG. 1 to an open position as shown in FIG. 2, for example. This spreading movement occurs when the control valve 28 is set in a first control position whereby high pressure fluid is introduced into cylinder 22 on one side of the piston therein. When the control valve is set to a second flow control position, high pressure fluid is introduced into cylinder 22 on the other side of the piston therein whereby the piston rod is retracted causing the force arms 30 to close as the outer ends move toward one another from a position as shown in FIG. 2, for example, to the closed position shown in FIG. 1. Further, the design is such that the parts are constructed so that the force arms 30 are caused to move in unison at the same angular rate but in opposite directions as the piston moves in either direction within cylinder 22 under the influence of the high pressure hydraulic fluid applied to cylinder 22 under the control of the control valve 28.

Figure 5:
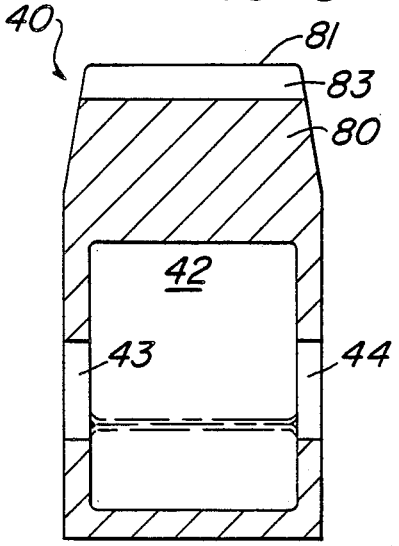
FIG. 5 is a sectional view taken on line 5—5 of FIG. 4.
Figure 4:
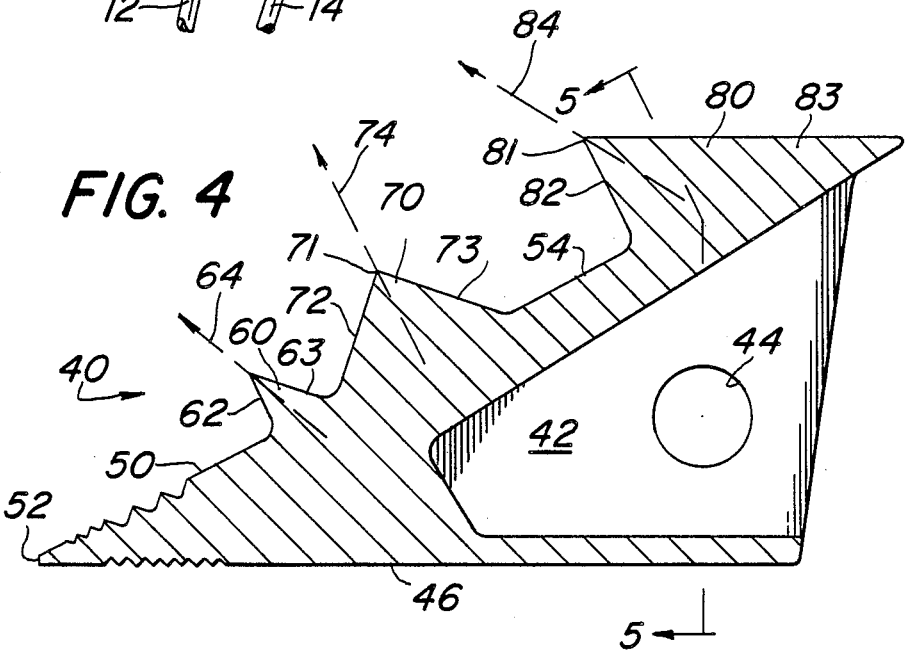
FIG. 4 is a sectional view taken on line 4—4 of FIG. 3.

In the case of the JL-32B spreading tool, the spreading force at the tips of the force arms is about 18,000 pounds and the opening distance between the closed position and a fully-opened position is approximately thirty-two inches. Also, as is conventional, and as is the case with the JL-32B spreading tool, the force arms 30 have a substantially triangular shape and are of a high strength construction. To this end, the longitudinal extending edge flanges of the force arms 30 taper toward one another progressively towards the outer or tip ends thereof. Also, as is conventional, the force arms 30 are provided with outwardly projecting tongue portions which are adapted to receive replaceable jaws, such as the jaws 40 in accordance with the invention. To this end, each jaw 40 has a triangular shape and is provided with a cavity or socket 42 configured as shown in FIGS. 4 and 5 and adapted to fit snuggly over the projecting tongue portion of an associated force arm 30. Each jaw 40 is also provided with aligned bore holes 43 and 44 adapted to receive a pin 38 which also extends through a bore in the projecting tongue portion of the force arm 30 to secure a jaw 40 on the tip end thereof.

The above-described structure is entirely conventional and is employed in the JL-32B spreading tool. The jaws, or tips as they are referred to in the art, of the prior art also have a triangular construction and are provided with ratchet teeth on the surfaces thereof facing in the direction of the spreading movement, which teeth are designed to grip and hold against surfaces. As was discussed above, the ratchet teeth construction in accordance with the prior art comprises a plurality of closely-positioned, shallow saw-tooth like teeth. In accordance with the invention, the tooth construction is such that the teeth bite into and grab the material being worked on to maintain the jaw 40 in engagement therewith throughout the entire spreading movement of the tool 10.

In accordance with the invention, the jaw 40 has a triangular construction which includes an inner surface 46 which extends generally parallel to the longitudinal axis of the tool 10 in the closed position thereof and a work engaging surface 50 extending from the tip end of the jaw 40 along a plane facing toward the spreading direction of the tool 10.

Jaw 40 is provided with a novel tooth design comprising three main teeth 60, 70 and 80 projecting from surface 50. Tooth 60 is located closest to the tip end 52 of jaw 40 and is spaced inwardly therefrom about a third of the overall length of surface 50. Tooth 60 has a depth (i.e., the distance above the top of surface 50) of ½ inch. Thus, tooth 60 is twice as deep as the conventional teeth in use today which have a depth of ¼ inch. Tooth 60 has a triangular shape with its base extending along surface 50, its outwardly facing surface 62 extending perpendicular to surface 50, and its inwardly facing surface 63 extending from the apex or tip end 61 of tooth 60 at an angle of about 45° with surface 62. Thus, surface 63 makes an angle of about 135° with the portion of the surface 50 extending inwardly from tooth 60. By this construction, tooth 60 points outwardly toward the tip end 52 of jaw 40. The pointing direction of tooth 60 is illustrated by the bisector of the tip angle of tooth 60 which bisector is indicated by dashed line 64.

Tooth 70 is located adjacent tooth 60 inwardly thereof and has a depth of ¾ inch, i.e., the tip end 71 thereof is about ¾ inch above the top surface 50. Tooth 70 has a triangular shape with its base extending along surface 50, its outwardly facing surface 72 extending at an angle of 135° with the part of surface 50 extending outwardly (toward the tip end of jaw 40) therefrom, and its inwardly facing surface 73 extending from the apex or tip end 71 of tooth 70 at an angle of 90° with tooth surface 72. Thus, the inwardly facing surface 73 of tooth 70 is at an angle of about 135° with the part of surface 50 extending inwardly from tooth 70. By this construction, tooth 70 points in a direction perpendicular to the surface 50, as is apparent from the showing of the bisector of the apex angle of tooth 60, which bisector is indicated by the dashed line 74.

Tooth 80 is located at the inner end of jaw 40 and is spaced apart a substantial distance (almost 2 inches at the tips) from tooth 70. Tooth 80 is the largest tooth on jaw 40 and has a depth of about 1 inch. Tooth 80 has a triangular shape with its base extending along surface 50, its outwardly facing surface 82 extending perpendicular to surface 50, and its inwardly facing surface 83 extending from the apex or tip end 81 of tooth 80 at a 60° angle with tooth surface 82. By this construction, tooth 82 points in a direction outwardly toward the tip end 52 of jaw 40 as is apparent from the bisector of the apex angle of tooth 80, which bisector is indicated by the dashed line 84. In accordance with the invention, there is provided a large recessed or notched area 54 between teeth 70 and 80 whereby the tip ends 71 and 81 are spaced a substantial distance (almost 2 inches) and there is provided a large recessed area between the tooth surfaces 73 and 82, for a purpose to be described more fully hereafter.

As discussed above, the teeth design in accordance with the invention is novel in the size, configuration, orientation and arrangement of the teeth thereon. Thus, the teeth 60, 70 and 80 all have a substantial depth (much deeper than the conventional teeth in use today) and differ in their depth, with tooth 60 having a $\frac{1}{4}$ inch depth, tooth 70 having a $\frac{3}{4}$ inch depth and tooth 80 having a 1 inch depth. Also, the teeth 60, 70 and 80 all point in a different direction from the surface 50 of jaw 40 with teeth 60 and 80 pointing in an outward direction at acute angles of 67.5° and 60°, respectively, toward the tip end 52 of the jaw 40 and with tooth 70 pointing perpendicular to the jaw. Also, there is provided a large notched area 54 between teeth 70 and 80.

The combination of the varying geometric shapes, the varying heights, the varying orientation and the spaced arrangement of the teeth 60, 70 and 80 all combine to ensure that the teeth of jaw 40 have the ability to bite into and grab or grip the material being acted on so that the jaw 40 holds onto or maintains engagement with the part being spread throughout the spreading movement of the force arms 30 of the spreading tool 10. It will be seen that as the jaw 40 moves through an angular movement during a spreading movement of force arms 30, the teeth 60, 70 and 80 will change in their orientation and the direction they point toward the working surface whereby there will always be at least one of the jaws pointing in an effective, preferably close to perpendicular, direction toward the working surface for biting into or gripping the same. Further, the substantial size gap at notched area 54 between the teeth 70 and 80 provides the ability to grab a steering column or other large surface with a much more stable contact than with the prior jaws. Further, the large tooth 80 at the inner end of jaw 40, which tooth is pointed toward the tip end of the jaw 40, is configurated and oriented to engage the working surface and prevent the jaw 40 from jumping forward or slipping off of the working surface. A further feature is the ability of the jaw 40 to break concrete block by reason of the large teeth 60, 70 and 80 sticking out so as to crush the concrete material as the jaws 40 are forced thereagainst.

Another feature of the jaw construction in accordance with the invention is the provision of the flat surface 83 at the inner end of jaw 40, which surface has a substantial area and extent and is parallel to the inner surface 46 of jaw 40. As shown in FIG. 1, both tooth surface 83 and jaw surface 46 extend generally parallel to the longitudinal axis of piston 24 and cylinder 22. The surface 83 is very useful in spreading operations where the jaws of a spreading tool 10 must be pushed against a surface extending at an angle to the working surface 50 of the triangular-shaped jaw 40. An example of such an operation is when the jaws are used to push a car seat backwardly. With the prior art jaw construction, there is always an angle-to-angle contact throughout the spreading stroke because the working surface of the jaw extends at an angle to the inner surface thereof. However, with the jaw construction of the invention, wherein there is provided surface 83 parallel to surface 46, the spreading tool 10 can be used to apply a force parallel to the surface of the material to be worked even though the force arm 30 moves at an angle to such surface. This gives much greater stability to the spreading operation.

FIG. 2 illustrates the use of a spreading tool 10 provided with a pair of jaws 40 for gaining access to an automobile by way of a side door. In this operation, the spreading tool 10 is opened partially to initially position the jaws 40 in contact with the upper and lower frames of the door window. The jaws 40 are positioned with the jaw teeth in overlying relationship with the window frames. After the jaws 40 have been positioned, a vertical lift operation is performed by actuating the force arms 30 to spread the jaws 40 apart to a position as illustrated in FIG. 2. This causes the lower portion of the door window to collapse (since the roof extending across the top thereof is more rigid than this portion of the door) to thereby create an open space at the door seam where the door latch is located. Spreading tool 10 is then collapsed to its closed position and placed in this open space and another spreading operation is performed to move the door to break the door latch. The door can then be opened to provide access to the interior of the automobile. With the prior art jaws, the vertical lift operation described above could result in the spreading tool being drawn into the interior of the automobile after the spreading movement has proceeded a certain amount. However, with the jaw construction of the invention, this problem is obviated because the large tooth 80 of each jaw 40 engages the door window frames in a manner to prevent this movement, said teeth 80 cooperating with the other teeth 60 and 70 which also bite into the window frame as is illustrated in FIG. 2.

It will be apparent that various parts of the disclosed embodiment of the invention can be modified without departing from the scope thereof as is defined by the following claims.

What is claimed is:

1. For use with a fluid operated rescue tool having a pair of elongated force arms pivotally supported at the inner ends thereof on a tool body for angular movement between a closed and a spread position, the force arms being generally adjacent to each other in the closed position and the outer ends of the force arms being in a spread apart relation to each other in the spread position, a jaw on the ends of the force arms for engaging a part to be spread, said jaw having a working surface facing in the spreading direction for contacting the part to be spread and including a plurality of teeth protruding above the working surface for engaging the part to be spread, said plurality of teeth including a first tooth located near the inner end of said jaw and having a substantial depth, a second tooth spaced a substantial distance away from said first tooth in a direction toward the tip end of said jaw and having a substantial depth but less than the depth of said first jaw, and a third tooth located outwardly along the extent of said jaw toward the tip end thereof from said second tooth, said third tooth having a depth smaller than the depth of said second tooth, said teeth having a substantial depth and configuration for biting into and grabbing the part being spread, said working surface extending from the outer tip end of said jaw to said inner end thereof, said third tooth being spaced inwardly from the outer tip end of said way at least about one quarter of the overall extent of said working surface.

2. A jaw according to claim 1 wherein said jaw has a triangular construction and includes an inner surface extending at an acute angle to said working surface from the tip end of said jaw, said first tooth having a tooth surface extending generally parallel to said inner surface, said tooth surface being located to extend in a plane substantially beyond the adjacent part of the outer end of said force arm on which said jaw is mounted to prevent any contact with the part to be spread by said force arm during the pivotal movement thereof between a closed and a spread position.

3. A jaw according to claim 1 wherein at least two of said teeth are pointed from said working surface of said jaw toward the tip end of said jaw.

4. A jaw according to claim 3 wherein said teeth are all pointed in different directions from said working surface of said jaw.

5. A jaw according to claim 4 wherein said second tooth is pointed perpendicular to said working surface of said jaw and said first and third teeth are pointed toward the tip end of said jaw.

6. A jaw according to claim 1 wherein said second tooth is spaced a substantial distance away from said the tip end of said jaw to provide a substantial gap therebetween along said working surface so that said first and second teeth can bite onto a large portion of said engaged part received within said gap.

7. For use with a fluid operated rescue tool having a pair of elongated force arms pivotally supported at the inner ends thereof on a tool body for angular movement between a closed and a spread position, the force arms being generally adjacent to each other in the closed position and the outer ends of the force arms being in a spread apart relation to each other in the spread position, a jaw on the ends of the force arms for engaging a part to be spread, said jaw having a working surface facing in the spreading direction for contacting the part to be spread and including a plurality of teeth protruding above the work surface for engaging the part to be spread, said plurality of teeth including a first tooth located near the inner end of said jaw and having a substantial depth, a second tooth located between said first tooth and the tip end of said jaw and having a substantial depth, and a third tooth located between said second tooth and the tip end of said jaw and having a substantial depth, two of said teeth being pointed from said working surface of said jaw toward the tip end of said jaw.

8. A jaw according to claim 7 wherein said teeth are all pointed in different directions from said working surface of said jaw.

9. A jaw according to claim 6 wherein said second tooth is pointed perpendicular to said working surface of said jaw and said first and third teeth are pointed toward the tip end of said jaw.

10. A jaw according to claim 9 wherein each of said first, second and third teeth have different depths.

11. A jaw according to claim 7 wherein said second tooth is spaced a substantial distance away from said first tooth in a direction toward the tip end of said jaw to provide a substantial gap therebetween defining a recess for receiving a large portion of the part engaged by said jaw.

12. A jaw according to claim 9 wherein the apex angle at the point end of said second tooth is about ninety degrees and wherein said first tooth has a depth of about 1 inch, said second tooth has a depth of about $\frac{3}{4}$ of an inch and said third tooth has a depth of about $\frac{1}{4}$ inch.

13. A jaw according to claim 7 wherein said jaw has a triangular construction and includes an inner surface extending at an acute angle to said working surface from the tip end of said jaw, said first tooth having a tooth surface extending generally parallel to said inner surface.

14. A jaw according to claim 10 wherein the apex angle at the pointed end of each of said first and second teeth is less than ninety degrees.

15. For use with a fluid operated rescue tool having a pair of elongated force arms supported at the inner ends thereof on a tool body for movement between a closed and a spread position, a jaw on the ends of the force arms for engaging a part to be spread, said jaw having a working surface facing in the spreading direction for contacting the part to be spread and including a plurality of teeth protruding above the work surface for engaging the part to be spread, said plurality of teeth including a first tooth located near the inner end of said jaw and having a substantial depth, a second tooth spaced a substantial distance away from said first tooth in a direction toward the tip end of said jaw to provide a substantial gap therebetween and having a substantial depth but less than the depth of said first jaw, and a third tooth located outwardly along the extent of said jaw from said second tooth, said third tooth having a depth smaller than the depth of said second tooth, two of said teeth being pointed from said working surface of said jaw toward the tip end of said jaw.

16. A jaw according to claim 15 wherein said second tooth is pointed perpendicular to said working surface of said jaw.

17. A jaw according to claim 15 wherein said jaw has a triangular construction and includes an inner surface extending at an acute angle to said working surface from the tip end of said jaw, said first tooth having a tooth surface extending generally parallel to said inner surface.

18. A jaw according to claim 1 wherein the depth of at least one of said teeth is at least about ½ the extent of said tooth along said working surface.

19. A jaw according to claim 3 wherein each of said two teeth pointed the tip end of said jaw comprises a pair of tooth surfaces extending from an apex angle at the tip end of the tooth, the bisectors of said apex angles extending toward the tip end of said jaw.

20. A jaw according to claim 6 wherein said first tooth has a tooth surface facing toward the tip end of said jaw, said second tooth having a tooth surface facing in a direction toward said tooth surface of said first tooth and away from the tip end of said jaw, said last-named tooth surfaces joining the working surface at locations spaced apart from each other a substantial distance to thereby provide said substantial gap between said first and second teeth.

* * * * *